United States Patent [19]

Asbury

[11] 4,078,693

[45] Mar. 14, 1978

[54] TEAR-OPEN CAN LID WITH PUSH-IN TAB

[76] Inventor: Charles T. Asbury, 717 Isle of Palms, Ft. Lauderdale, Fla. 33301

[21] Appl. No.: 814,269

[22] Filed: Jul. 11, 1977

[51] Int. Cl.[2] ..... B65D 41/32

[52] U.S. Cl. ..... 220/268

[58] Field of Search ..... 220/265-273; 222/541

[56] References Cited

U.S. PATENT DOCUMENTS 3,355,058 11/1967 Asbury ..... 220/268

3,779,417 12/1973 Klein ..... 220/268

*Primary Examiner*—George T. Hall

*Attorney, Agent, or Firm*—Oltman and Flynn

[57] ABSTRACT

The present can lid has an embossed, raised tab with a circumferentially, narrow, radially elongated segment terminating in a point at its inner end. The lid has a double score line in the bottom extending from this point along the opposite sides of the tab. The outer end of the tab is joined permanently to the remainder of the lid at an unscored segment.

10 Claims, 17 Drawing Figures

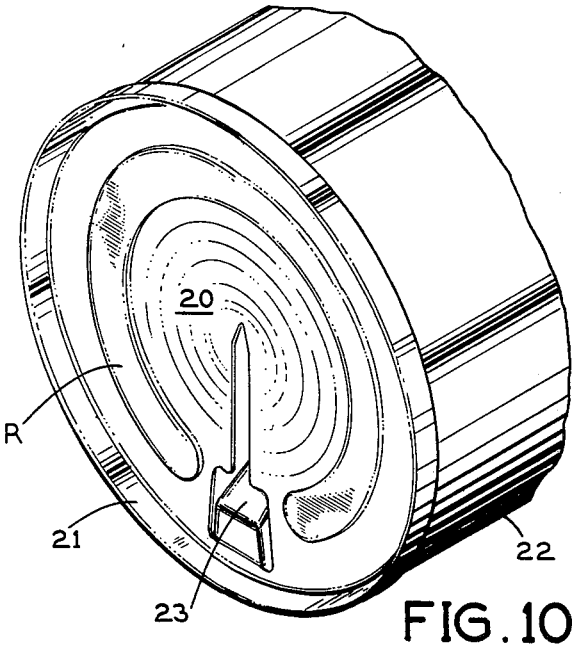
FIG. 10
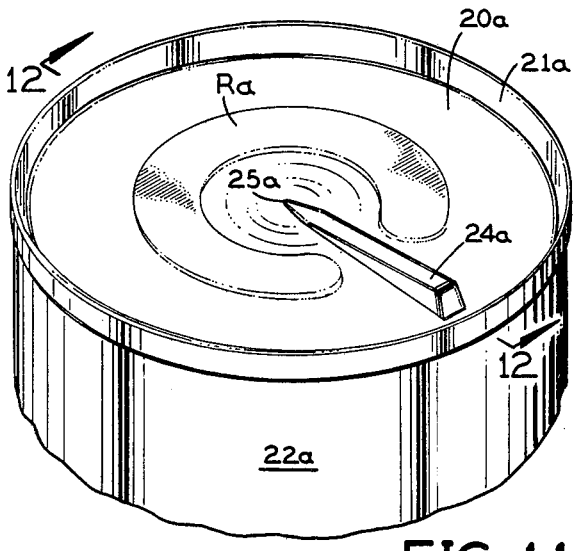
FIG. 11
FIG. 12
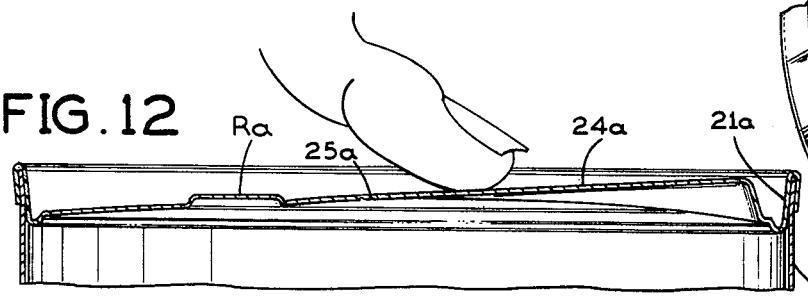
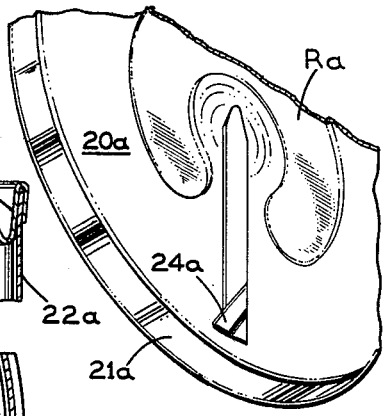
FIG. 15
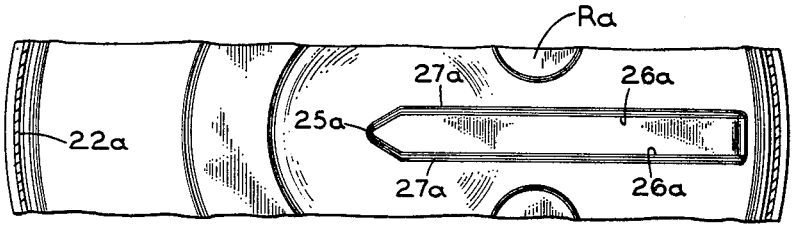
FIG. 13
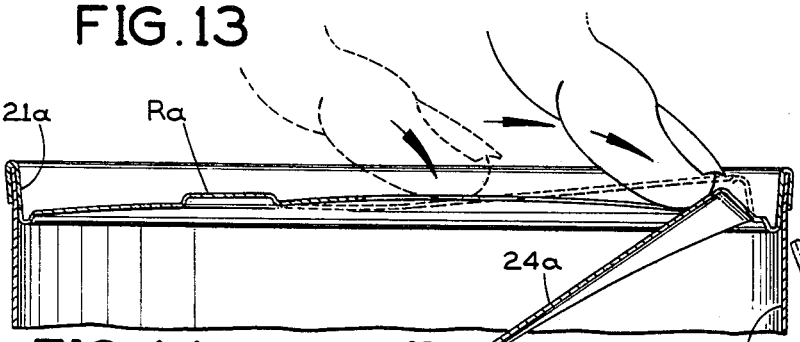
FIG. 14
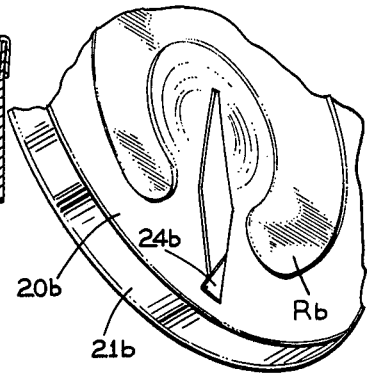
FIG. 17
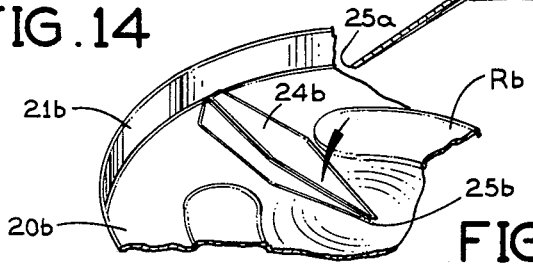
FIG. 16

TEAR-OPEN CAN LID WITH PUSH-IN TAB

BACKGROUND OF THE INVENTION

Various tear-open lids have been proposed heretofore for beer and carbonated soft drink cans.

For example, my U.S. Pat. Nos. 3,227,304, 3,246,791 and 3,355,058 show tear-open push-in tabs which are permanently joined to the remainder of the can lid, so that after being pushed in to provide the pour opening the tab remains attached to the can lid. Earlier examples of push-in tabs which remain attached to the can lid after being pushed in are shown in U.S. Pat. No. 2,176,898 to Fried and U.S. Pat. No. 2,261,117 to Jack.

SUMMARY OF THE INVENTION

The present invention is directed to a tear-open can lid having a push-in tab of novel construction which satisfies the following criteria:

(1) the tab in the lid can be pushed open relatively easily and simply;

(2) the user's finger or thumb is not liable to be cut by pushing in the tab;

(3) a pour opening of adequate size is provided in the lid after the tab has been pushed in; and (4) the pushed-in tab remains permanently attached to the lid.

In accordance with the presently preferred embodiment of this invention, these objectives are achieved by providing a tab which is embossed in and raised up from a crowned can lid and which has:

(1) a permanent attachment of the outer end of the tab to the remainder of the lid;

(2) a circumferentially narrow, radially elongated segment of the tab extending radially inward to a reduced-width segment at its inner end extending slightly beyond the center of the lid;

(3) and a double score line in the bottom of the lid extending from this inner end along the opposite sides of the radially elongated tab segment.

The tab is pushed in by the user's applying finger or thumb pressure against the narrow elongated tab segment to tear the tab free first at its reduced inner end slightly beyond the center of the crowned lid, which snaps inward with an "oil can" type of snap action that insures that the seal will be broken at this location for releasing the gas pressure inside the can to the atmosphere. Then the user slides his thumb or finger radially outward of the lid along the radially elongated segment of the tab to tear the tab from the lid progressively outward along the opposite sides of the radially elongated tab segment. The width of the tab along its narrow, radially elongated inner segment is less than the width of the user's finger or thumb and preferably is 0.160 inch or less. This narrow tab width in combination with the closely spaced inner and outer score lines in the bottom of the lid insures that the user will not be liable to cut his or her finger or thumb on the edges of the opening formed in the lid by the separation of the tab from the remainder of the lid. The tab is torn free along the inner score line and the adjacent edge segment between the inner and outer score lines bends inward around the outer score line to present a rounded, convex top edge surface along this opening.

In one embodiment the tab also has an outer end segment which is relatively large both circumferentially and radially and is attached integrally to the outer end of the narrow, radially elongated inner tab segment.

The tab is permanently attached to the remainder of the lid at the outer edge of its outer end segment.

In other embodiments of the invention the narrow elongated segment constitutes the entire tab.

A principal object of this invention is to provide a tear-open can lid having a novel and improved push-in tab integral therewith.

Another object of this invention is to provide a can lid with such a push-in tab which can be readily opened relatively easily and without danger of cutting the user's thumb or finger.

Further objects and advantages of this invention will be apparent from the following description of three presentlypreferred embodiments, which are shown in the accompanying drawing in which:

FIG. 1 is a perspective view of a first embodiment of the present lid on the upper end of can before the tab is pushed in;

FIG. 7 is a view similar to FIG. 3 showing the tab being pushed in;

FIG. 8 is a fragmentary top perspective view of the lid with the tab pushed in;

FIG. 10 is a perspective view of the complete lid after the tab has been pushed in;

FIG. 11 is a perspective view of a second embodiment of the present lid on the upper end of a can;

FIG. 12 is a section taken along the line 12—12 in FIG. 11 longitudinally of the raised tab and showing the user's finger pushing in on this tab;

FIG. 13 is a fragmentary bottom plan view of the FIG. 11 lid with its raised tab;

FIG. 14 is a view similar to FIG. 12, showing how the tab is pushed in;

FIG. 15 is a fragmentary perspective view of this second embodiment of the present can lid with the tab pushed in;

FIG. 16 is a fragmentary perspective view of a third embodiment of this invention with a modified push-in tab; and FIG. 17 is a view similar to FIG. 16 showing the tab pushed in.

Figure 1:
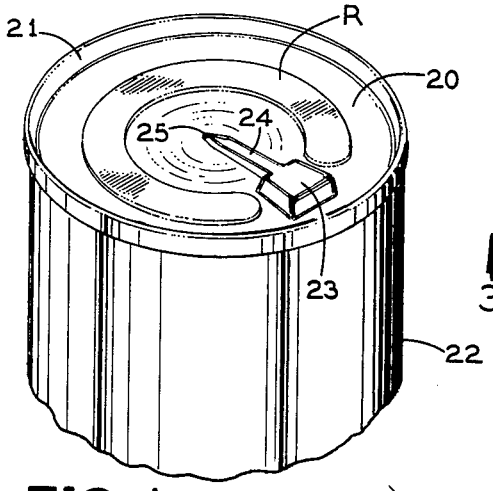
Figure 2:
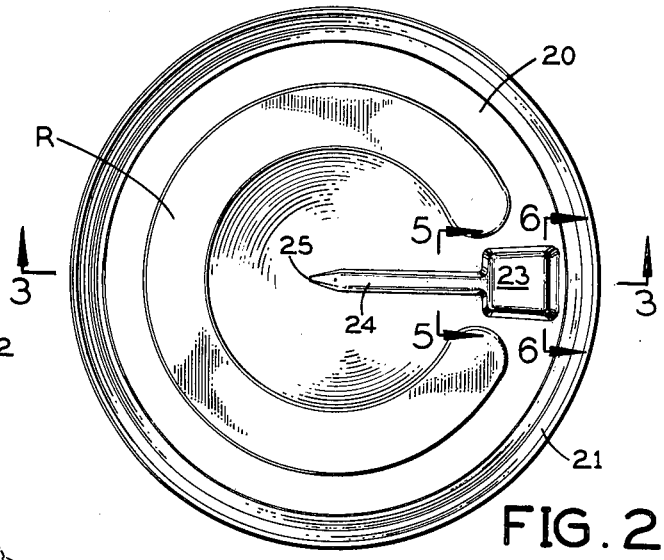
FIG. 2 is a top plan view of this lid on the can.
Figure 3:
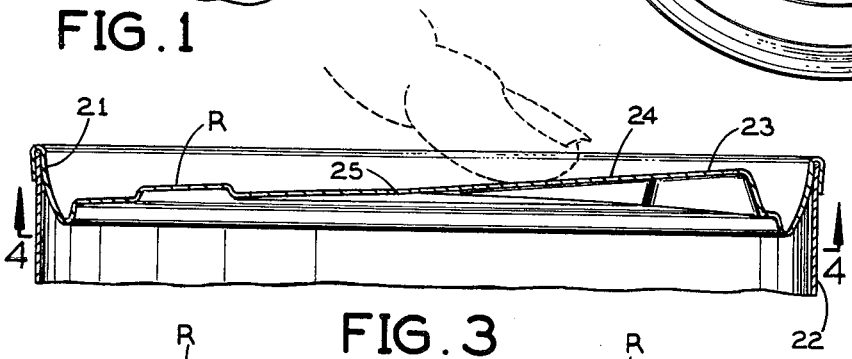
FIG. 3 is a cross-section taken along the line 3—3 in FIG. 2 longitudinally of the raised tab.
Figure 5:
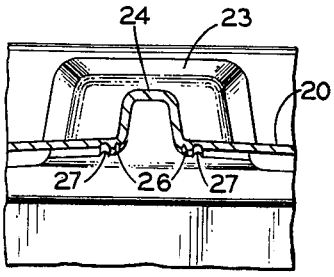
FIG. 5 is a cross-section taken along the line 5—5 in FIG. 2 transversely through this tab.

Before explaining the disclosed embodiments of the present invention in detail, it is to be understood that the invention is not limited in its application to the details of the particular arrangements shown since the invention is capable of other embodiments. Also, the terminology herein is for the purpose of description and not of limitation.

Referring first to FIGS. 1–10, the can lid 20 is of thin sheet metal, such as aluminum or galvanized steel, or a suitable plastic, and is of circular outline. Preferably, the lid is of aluminum 0.015 inch thick and its outside diameter is 3 inches or 2.75 inches, typically. At its circular periphery the lid has a raised rib 21 which is rolled down over the top edge of the cylindrical can body 22 in a known manner to provide a permanent, fluid-tight seal between the lid and the can body. In the embodiment shown the lid is formed with an embossed, upwardly offset, flat arcuate rib R to enhance its strength. However, it is to be understood that this raised rib may be omitted, if desired. Inward from this rib R the lid is crowned, presenting a convex top face which has its high point at the center of the lid.

In accordance with the present invention a tab is embossed in the lid, forming an upwardly offset, raised region integral with the remainder of the lid.

In the embodiment of FIGS. 1–10, this tab has a flat-topped outer segment 23 of appreciable size both circumferentially and radially and a radially elongated, circumferentially narrow flat-topped inner segment 24 which extends between the ends of the rib R radially inward from the outer segment 23 and preferably terminates at its inner end in substantially a point at 25 slightly beyond the center of the lid.

In one practical embodiment, for a $2\frac{3}{4}$ inch diameter can lid the outer segment 23 of this tab has a circumferential dimension of 0.375 inch and a radial dimension of 0.375 inch, and the narrow inner segment 24 has a radial length of 0.75 inch from its connection to the outer segment 23 to its point 25 and a circumferential width of 0.160 inch or less along its entire length except at its inner end where it tapers to the point 25. The tab has a flat top face which tapers upward along its length from the point 25 at its inner end, where it is coplanar with the remainder of the lid to a maximum height above the remainder of the lid of about 0.125 inch at its enlarged outer end segment 23. The point 25 is about 0.125 inch on the opposite side of the center of the lid from the outer end segment 23 of the tab.

Figure 4:
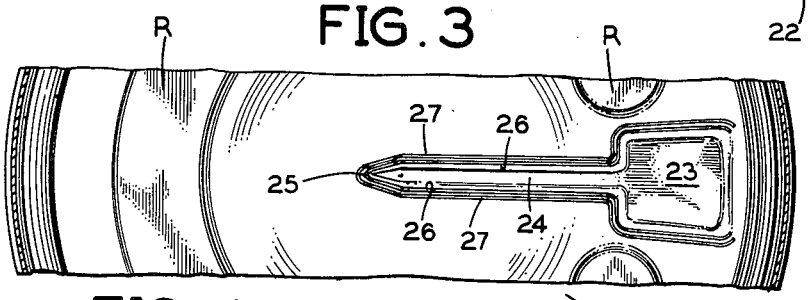
FIG. 4 is a fragmentary bottom plan view of the lid showing the raised tab in accordance with this first embodiment of the invention.
Figure 6:
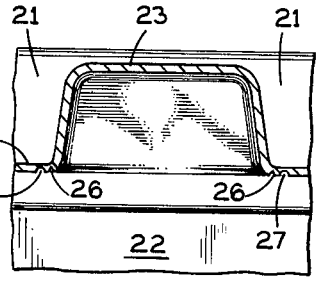
FIG. 6 is a similar view taken along the line 6—6 in FIG. 2.
Figure 7:
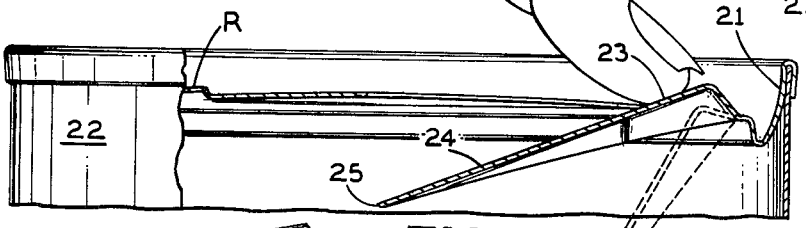
Figure 8:
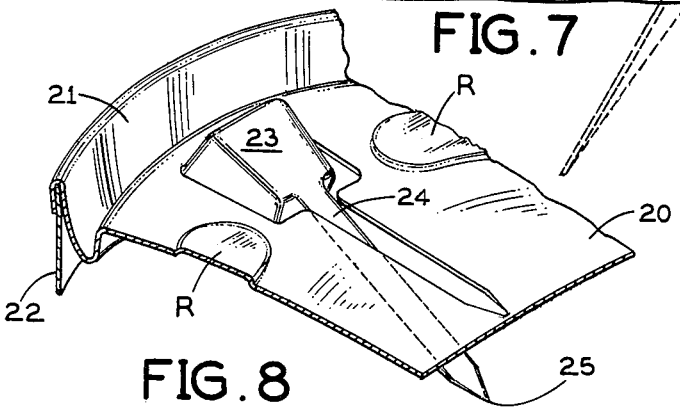

The tab is defined by an inner score line 26 indented into the bottom of the lid (FIGS. 4 and 5) to a suitable depth enabling the tab to be norm manually from the remainder of the lid. For a 0.015 inch thick aluminum lid the depth of this score line is about 0.005 inch. This score line extends outward from the point 25 continuously along the opposite sides of the inner segment 24 of the tab and then along the radially inward edges and the opposite side edges of the outer segment 23 of the tab, as best seen in FIG. 4. The inner score line 26 terminates on opposite sides of the outer tab segment 23 at the latter's radially outward edge, so that the lid presents an unscored segment of appreciable circumferential extent connecting the outer edge of the tab permanently to the remainder of the lid.

An outer score line 27 of about the same depth in the bottom of the lid extends in close proximity to the inner score line 26 along the latter's entire length. In one practical embodiment the spacing between the two score lines is about 0.015 to 0.020 inch. The outer score line 27 insures that the narrow edge segment between the two score lines will assume a convex curvature, viewed from above, when the tab is pushed in and torn loose along the inner score line 26. That is, the edge at the inner score line 26 will be displaced downward (into the can) and the downwardly bent, rounded edge segment next to it will present a smooth surface to the user's finger or thumb, so that it is virtually impossible to cut himself or herself along the edge at 26.

In the use of this can lid, the user presses in with a finger or thumb (FIG. 3) on the narrow inner segment 24 of the raised tab close to the point 25 at its inner end to cause the tab to tear loose from the remainder of the lid first at the point 25. The user then slides the finger or thumb progressively outward along the tab (FIG. 7) to cause the latter to tear loose from the remainder of the lid along the inner score line 26 outward along the opposite sides of the inner segment 24, then along the inner edges of the outer tab segment 23, and finally along the opposite side edges of the outer segment 23.

When the lid is first pierced at the point 25, this releases the gaseous contents of the can, which usually will be somewhat pressurized, and following this the tab offers very little resistance to being torn from the remainder of the lid along the inner score line. When the inner segment 24 is first pushed in the domed or crowned lid 20 has the well-known "oil-can" effect, snapping over at the middle from its normal curvature, convex at the top, to the reverse curvature, convex at the bottom. This snap action movement of the crowned lid greatly assists its initial separation from the tab at the point 25.

The circumferentially narrow width of the inner segment 24 of the tab enhances its rigidity, so as to facilitate making the initial separation at its inner end point 25. In addition, the narrowness of the inner segment 24 of the tab insures that the user's finger cannot pass down into the corresponding opening formed in the lid by the separation of this segment of the tab. Also, the provision of the double score line 26,27 in the bottom of the lid insures that the tear line at the inner score line 26 will be somewhat convex, viewed from above, and will present a smooth, rounded surface to the user's finger or thumb with virtually no chance of cutting it.

The torn edges along the outer segment 23 of the tab enhance the size of the pour opening after this segment is separated from the remainder of the can lid. The outer segment 23 of the tab remains permanently attached along its outer edge to the remainder of the lid.

Figure 9:
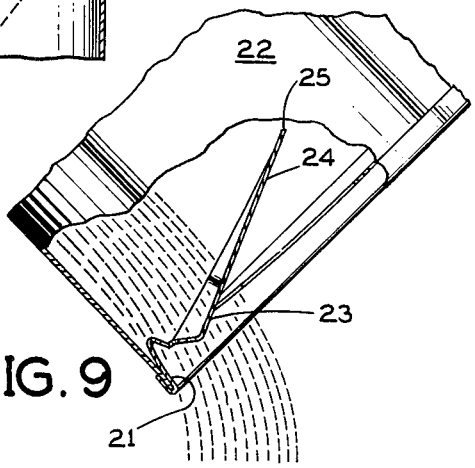
FIG. 9 is a view, partly in elevation and partly in section, showing the can inverted to pour out its liquid contents through the opening formed by pushing in the tab.

The liquid contents of the can can be poured out by inverting the can, as shown in FIG. 9, after the tab has been pushed in, as described.

FIGS. 11–15 show a second embodiment of the invention in which the tab consists entirely of a circumferentially narrow, radially elongated, segment **24*a* which is of uniform width (circumferentially) except for the reduced-width segment at its inner end which is rounded, as shown at 25*a***. Corresponding elements of this second embodiment are given the same reference numerals, but with an "*a*" suffix added, as in the embodiment of FIGS. 1–10, and the detailed description of these correspondingly numbered features will not be repeated. This lid has a double score line in the bottom (the same as in the first embodiment), as shown as **26*a* and 27*a* in FIG. 13. This double score line terminates on the opposite sides of the elongated narrow tab 24*a*** at its outer edge so that here the tab remains permanently attached to the remainder of the lid.

FIGS. 16 and 17 show a third embodiment of the invention in which the tab is narrow throughout its radial extent outward from its inner end. In this embodiment the narrow tab **24*b* tapers slightly along each side away from its squared-off inner end at 25*b*** to a maximum width about midway along its length, and then tapers slightly inward along each side to its unscored attachment of its outer end to the remainder of the lid. Corresponding elements of this third embodiment are given the same reference numerals, but with a "*b*" suffix added, as in the embodiment of FIGS. 11–15, and the detailed description of these correspondingly numbered features will not be repeated. This lid has a double score line in the bottom, as already described, which terminates at the outer edge of the tab 24*b*, so that the tab has a permanent attachment at its outer end to the remainder of the lid.

In both the second and third embodiments, the tab 24*a* or 24*b* has a maximum width (circumferentially) of 0.160 inch or less to prevent the user's finger or thumb from being cut when the tab is pushed in. In these embodiments, the tab separates from the remainder of the lid first at its inner end at 25*a* or 25*b*, and then the remaining radial length of the tab is torn loose progressively radially outward along its length to its permanently attached outer edge.

It is to be understood that in the embodiment of FIGS. 1–10 the reduced-width segment at the inner end of the tab may terminate in a rounded or squared off edge instead of the point 25. Also, in each of the other embodiments the inner end of the tab may be substantially pointed, rounded or squared off.

For the purpose of insuring that the lid will bend down in the immediate vicinity of the torn edge along the inner score line 26 to avoid cutting the user's finger or thumb, the score line 26 may be V-shaped and have a width (e.g., 0.018 inch or more) at the bottom face of the lid which is greater than the thickness (e.g., 0.015 inch) of the lid. In that case the outer score line 27 in the bottom of the lid may be omitted.

I claim:

1. In a tear-open crowned can lid having a convex top face and a tab embossed in and forming an upwardly offset, raised region in the lid, the improvement wherein:

said tab has a narrow elongated segment extending transversely inward away from the circumferential edge of the lid and having a width not greater than substantially 0.160 inch, and said narrow elongated segment terminating in a reduced-width segment at its inner end, and said lid has a score line indented in the bottom which extends from the inner end of said tab continuously along the opposite sides of said narrow elongated segment of the tab to termination points which are spaced apart circumferentially of the lid along the outer edge of the tab, whereby to leave an unscored permanent connection between the outer edge of the tab and the remainder of the lid, whereby, upon pressing down on said narrow elongated segment, the lid snaps in at the center and the tab tears free from the remainder of the lid first at its inner end and then progressively outward along said score line on opposite sides of said narrow elongated segment to said termination points to provide a pour opening inward from said unscored permanent connection between the tab and the remainder of the lid at the outer edge of the tab.

2. A can lid according to claim 1, wherein said narrow elongated tab segment extends substantially radially of the lid, and its inner end is on the opposite side of the center of the lid from said unscored permanent connection of the tab to the remainder of the lid.

3. A can lid according to claim 1, wherein the lid has an outer score line idented into the bottom in close proximity to said first-mentioned score line along the latter's length for causing the lid to bend down about said outer score line into a convex curvature in a narrow edge region of the lid next to the torn edge at said first-mentioned score line when said elongated narrow tab segment is pushed in.

4. A can lid according to claim 3, wherein said narrow elongated tab segment extends substantially radially of the lid, and at its inner end is located close to the center of the lid.

5. A can lid according to claim 4, wherein said reduced-width segment at the inner end of the tab extends to the opposite side of the center of the lid from said unscored permanent connection of the tab to the remainder of the lid.

6. A can lid according to claim 5, wherein said tab also has a circumferentially enlarged segment at its outer end which is connected integrally to said narrow elongated segment at the latter's outer end, and said score line termination points are on the opposite sides of said circumferentially enlarged outer end segment, whereby said unscored permanent connection between the tab and the remainder of the lid extends along the outer edge of said circumferentially enlarged outer end segment.

7. A can lid according to claim 6, wherein said circumferentially enlarged outer end segment has an appreciable extent transversely inward from its outer edge to its connection to said narrow elongated segment.

8. A can lid according to claim 5, wherein said narrow elongated segment constitutes substantially the entire tab and has its outer end joined to the remainder of the tab at said unscored permanent connection.

9. A can lid according to claim 8, wherein said narrow elongated tab segment is of substantially uniform circumferential width throughout its radial length except in the vicinity of said reduced-width segment at its inner end.

10. A can lid according to claim 8, wherein the opposite sides of said narrow elongated tab segment taper away from each other for a portion of its length outward from said point and then taper toward each other for the remainder of its length outward to said unscored permanent connection to the remainder of the lid.

* * * * *